US006123217A

United States Patent [19]

Miller

[11] Patent Number: 6,123,217

[45] **Date of Patent: *Sep. 26, 2000**

[54] INFLATABLE COOLER

[75] Inventor: Michael J. Miller, Grosse Pointe Woods, Mich.

[73] Assignee: Manumit, LLC, Indianapolis, Ind.

[ * ] Notice: This patent issued on a continued prosecution application filed under 37 CFR 1.53(d), and is subject to the twenty year patent term provisions of 35 U.S.C. 154(a)(2).

[21] Appl. No.: 09/082,202

[22] Filed: May 20, 1998

[51] Int. Cl.[7] ..... B65D 30/00; B65D 90/02; F25D 3/06

[52] U.S. Cl. ..... 220/592.19; 4/588; 62/457.2; 62/457.4; 206/522; 220/666; 220/903; 383/3

[58] Field of Search ..... 220/592.19, 592.09, 220/903, 666, 62.18, 592.17; 383/3; 4/588; 62/457.1, 457.2, 457.3, 457.4, 457.7, 457.8; 206/522

[56] References Cited

U.S. PATENT DOCUMENTS

| | | | |
|---|---|---|---|
| 3,389,534 | 6/1968 | Pendleton | 206/522 X |
| 3,631,544 | 1/1972 | Tytel | 206/522 X |
| 4,085,785 | 4/1978 | Hoot | 206/522 X |
| 4,858,755 | 8/1989 | Kuivanen | 206/522 X |

*Primary Examiner*—Stephen P. Garbe
*Assistant Examiner*—Joe Merek
*Attorney, Agent, or Firm*—Fildes & Outland, P.C.

[57] ABSTRACT

An inflatable cooler having a tubular housing The housing includes an outer wall, a bottom wall and an open topped cooling chamber for receiving a standard sized beverage container. The outer wall supports, internally of the housing, a plurality of inflatable air chambers. An perimetric air chamber wraps around the periphery of the bottom wall and interconnects the air chambers. The air chambers are inflated by an air valve in the outer wall. When the air chambers are inflated, the cooler becomes self-supporting and relatively rigid.

6 Claims, 2 Drawing Sheets

INFLATABLE COOLER

FIELD OF THE INVENTION

This invention relates to inflatable containers and, in particular, to an inflatable cooler for keeping contents of a beverage container cold.

BACKGROUND OF THE INVENTION

It is known in the art relating to inflatable containers to provide an inflatable cooler to keep a beverage container cold when refrigeration is not available or practical. Inflatable containers are desirable to use because of their portability and convenient storage when not in use.

SUMMARY OF THE INVENTION

The present invention provides an inflatable cooler for cooling a standard sized beverage container, such as a beer keg.

The present invention also provides a cooler that is portable and convenient to store when not in use.

In addition, the present invention provides a cooler that removes the need to place coolant around the entire perimeter of the beverage container.

In carrying out the advantages of the invention, the cooler includes a tubular housing having an outer wall, a bottom wall and an open topped cooling chamber defined by the outer wall and the bottom wall. The beverage container is placed within the cooling chamber.

The outer wall supports an inner wall with inflatable air chambers defined between the inner and outer walls. The air chambers extend longitudinally between opposite ends of the outer wall and are circumferentially spaced around the interior of the outer wall. A continuous perimetric air chamber extends around the periphery of the bottom wall The annular air chamber interconnects the air chambers. The air chambers are inflated by inflating means in the outer wall. The air chambers, when fully inflated, abut against the beverage container, creating open topped pockets between the air chambers. Coolant for keeping the contents of the beverage container cold is placed only in the pockets and thus less ice is needed to cool the beverage container.

These and other features and advantages of the invention will be more fully understood from the following detailed description of the invention taken together with the accompanying drawings.

DETAILED DESCRIPTION OF THE INVENTION

Figure 2:
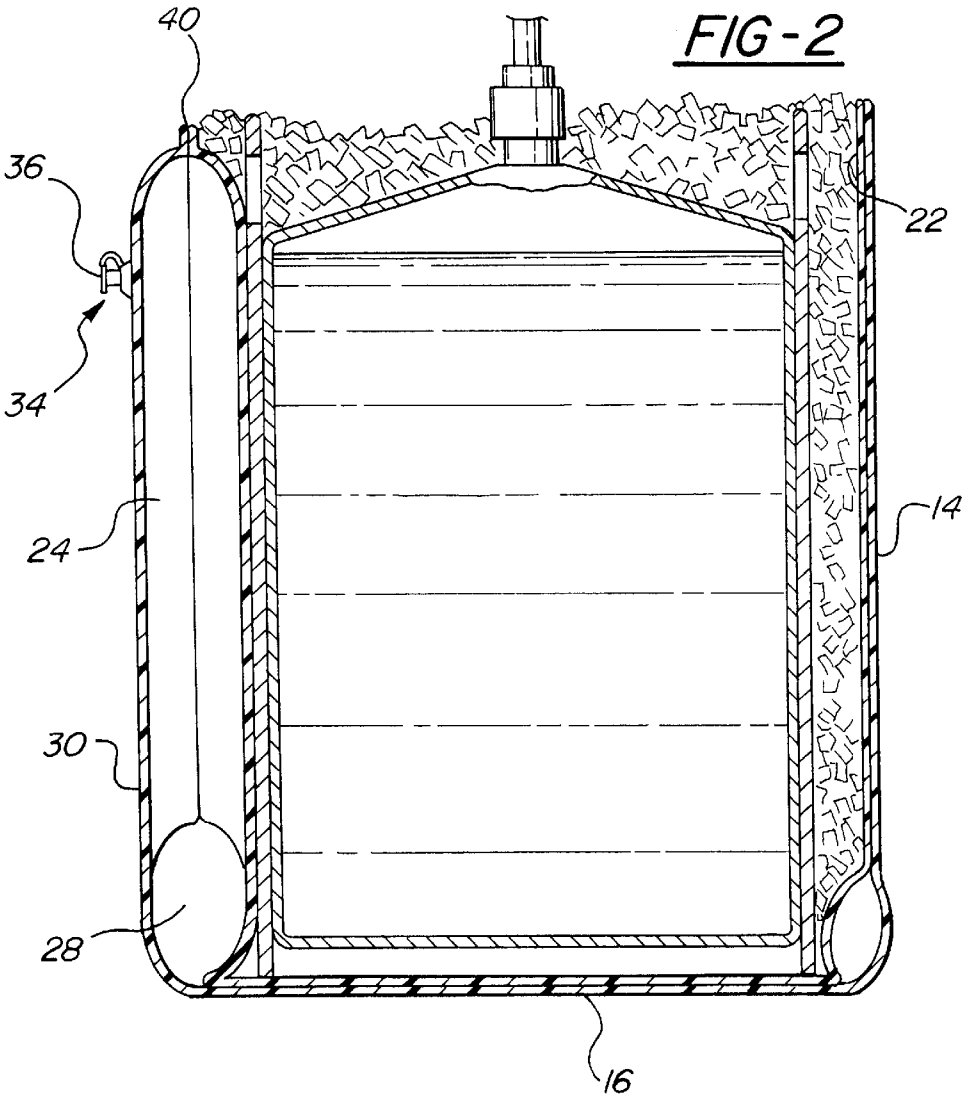
FIG. 2 is a cross-sectional view of the inflatable cooler of FIG. 1.

Referring now to FIGS. 1–4 of the drawings in detail, numeral 10 generally indicates an inflatable cooler having a tubular housing 12 made of a flexible material such as vinyl.

The housing 12 includes an outer wall 14, a generally polygonal-shaped bottom wall 16 and a cooling chamber 17 defined by the walls 14, 16 and having an open top 18 spaced from the bottom wall 16 for receiving into the chamber a standard sized beverage container 20.

The outer wall 14 supports, internally of the housing 12, an inner wall 22 defining a plurality of inflatable air chambers 24. The air chambers 24 extend longitudinally between opposite ends of the outer wall 14 and are perimetrically spaced around the interior of the outer wall 14. The air chambers 24, when fully inflated, abut against the beverage container 20, creating open topped pockets 26 between the air chambers 24.

A continuous perimetric air chamber 28 extends around the periphery of the bottom wall 16 at the lower end of the outer wall 14 and is an perimetric portion 30 of the inner wall 22. The perimetric air chamber 28 interconnects the air chambers 24. Inflating means 34 are provided for filling the air chambers 24 with air or a gas. The inflating means 34 include an air valve 36 mounted in the outer wall 14 on one of said sides of the housing 12 near upper end of one of the air chambers 24.

In a preferred embodiment, the inner and outer walls 22, 14 are secured together at the top thereof by heat welding or ultrasonic welding to form a top edge 40. The bottom wall 16 is welded to the lower ends 42, 44 of the inner and outer walls. The air chambers 24 are created by welding the inner and outer walls 22, 14 along longitudinal lines extending between the top edge 40 of the inner and outer walls 22, 14 and the perimetric air chamber 28. The perimetric air chamber 28 is created by welding the inner and outer walls 22, 14 along perimetrical lines extending between the lower ends 46 of the air chambers.

The outer wall 14 and the bottom wall 16 are each made from a sheet of vinyl. The vinyl provides structural support and resistance to puncturing of the walls 14, 16. The inner wall 22 may be made from a sheet of lighter gauge vinyl than the vinyl used for the outer wall 14 and the bottom wall 16. By using the lighter gauge vinyl for the inner walls 22 of the air chambers 24, the inner walls 22 have a greater flexibility than the outer wall 14. The flexibility of the air chambers 24 absorbs any expansion due to air or water pressure, and thus a relatively smoother surface is provided for the outer wall 14. The smooth surface provides an attractive area to place advertisements.

Figure 4:
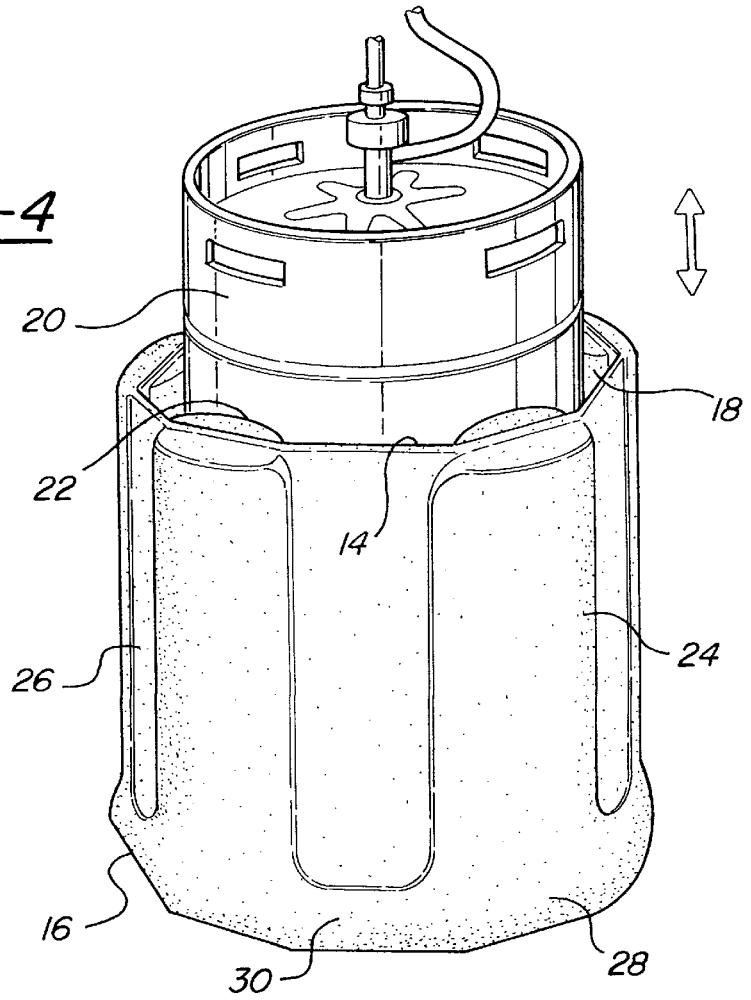
FIG. 4 is a pictorial view of the inflatable cooler illustrating the manner of placing the beverage container within the cooler.

In use, air is blown into the air chambers 24 through an air valve 36. First, the air chambers 24 are partially inflated to the point where the cooler 10 becomes self-supporting and relatively rigid. Next, the bottom wall 16 of the cooler 10 is covered with ice. A standard sized beverage container 20, such as a beer keg, is then placed in the cooler 10 through the open top 18 as shown in FIG. 4.

Figure 1:
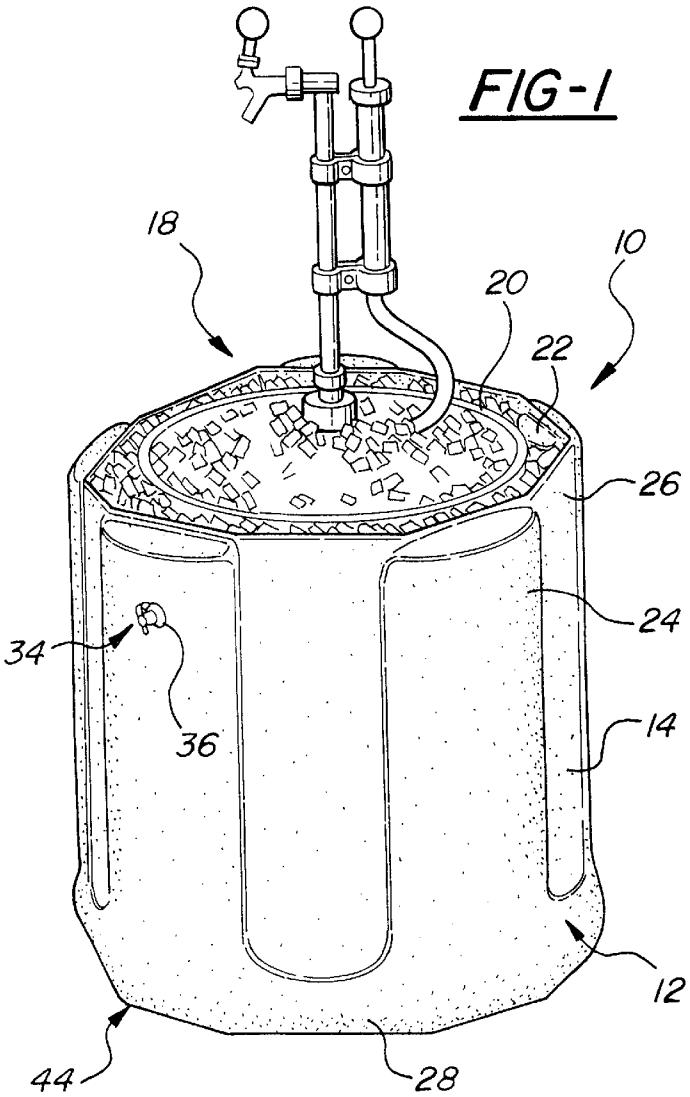
FIG. 1 is a pictorial view of the inflatable cooler containing the beverage container and ice.
Figure 3:
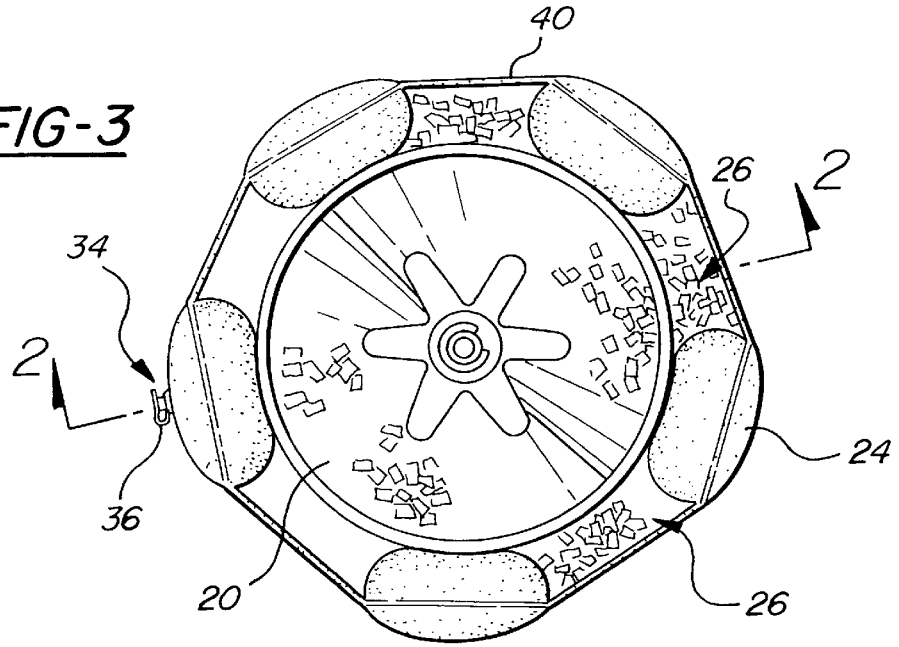
FIG. 3 is a top view of the inflatable cooler containing the beverage container.

Additional air is then blown into the air chambers 24, fully inflating the air chambers 24. The air chambers 24, when fully inflated, abut against the beverage container 20, creating pockets 26 between the air chambers 24 as illustrated in FIG. 3. Ice is placed into the pockets 26 and on the top of the beverage container as shown in FIG. 1. Because the air chambers 24 abut against the container 20, and provide insulating spaces, less ice is needed to cool the container 20.

To store the cooler 10, it is partially deflated and the beverage container 20 is removed. The ice and water are emptied from the cooler 10 and it is fully deflated. Then the cooler 10 may be folded and stored for the next use.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. An inflatable cooler comprising:

a tubular housing defining an open topped cooling chamber for receiving a beverage container, said open topped cooling chamber having an uppermost top edge, said housing having a generally polygonal-shaped bottom wall, said housing having an inner layer and outer layer joined so as to form inflatable air chambers and open topped pockets; said air chambers longitudinally extending and perimetrically disposed in an alternating manner around the periphery of the tubular housing, said open topped pockets longitudinally extending and alternating with said air chambers;

a continuous perimetric air chamber defined by bottom portions of the inner and outer layers forming the bottom of the open topped pockets and interconnecting the inflatable air chambers, said inner and outer layers forming a non-inflatable sidewall between the longitudinal air chambers, below the top edge and above the perimetric air chamber;

inflating means in one of said walls for inflating the air chambers.

2. The cooler of claim 1 wherein the annular air chamber is defined between the inner and outer walls of the cooler.

3. The cooler of claim 1 wherein the inflating means comprise an air valve mounted on one of said sides of the cylindrical housing near an upper end of one of the air chambers.

4. The cooler of claim 1 wherein said inner wall is of greater flexibility than the outer wall, allowing any expansion due to air or water pressure to be absorbed primarily by the inner wall portions of said air chambers, thereby providing a smoother surface on the outer wall than on the inner wall.

5. The cooler of claim 1 wherein the outer wall and base are made of vinyl, to provide structural support and resistance to punctures.

6. The cooler of claim 1 wherein the inner wall is made of a lighter gauge vinyl than that of the outer wall and the bottom wall, whereby the air chambers primarily absorb expansion due to air or water pressure, and a smoother surface is provided on the outer wall than on the inner wall.

* * * * *